US007134823B2

(12) United States Patent
Albrecht et al.

(10) Patent No.: US 7,134,823 B2
(45) Date of Patent: Nov. 14, 2006

(54) BOOK PRESSING MACHINE

(75) Inventors: Manfred Albrecht, Lübbecke (DE); Björn Hoffmann, Hüllhorst (DE); Christoph Schmücker, Lübbecke (DE)

(73) Assignee: Kolbus GmbH & Co. KG, Rahden (DE)

( * ) Notice: Subject to any disclaimer, the term of this patent is extended or adjusted under 35 U.S.C. 154(b) by 477 days.

(21) Appl. No.: 10/736,041

(22) Filed: Dec. 15, 2003

(65) Prior Publication Data

US 2004/0126204 A1 Jul. 1, 2004

(30) Foreign Application Priority Data

Dec. 14, 2002 (DE) ..... 102 58 502

(51) Int. Cl.
*B42C 13/00* (2006.01)

(52) U.S. Cl. ..... 412/22; 412/1; 412/9; 412/10; 412/23; 412/33

(58) Field of Classification Search ..... 412/1, 412/9, 10, 22, 23, 33
See application file for complete search history.

(56) References Cited

U.S. PATENT DOCUMENTS

| | | | | |
|---|---|---|---|---|
| 3,451,082 | A * | 6/1969 | Sarring | 412/5 |
| 4,978,267 | A * | 12/1990 | Kolkhorst | 412/21 |
| 5,114,293 | A * | 5/1992 | Rathert | 412/30 |
| 5,658,111 | A * | 8/1997 | Rathert | 412/30 |
| 6,250,868 | B1 * | 6/2001 | Schmucker | 412/25 |
| 6,497,544 | B1 * | 12/2002 | Schmucker et al. | 412/17 |
| 6,669,429 | B1 * | 12/2003 | Beermann et al. | 412/19 |
| 6,726,424 | B1 * | 4/2004 | Voss | 412/3 |
| 6,843,473 | B1 * | 1/2005 | Bohn et al. | 270/52.18 |

FOREIGN PATENT DOCUMENTS

| | | |
|---|---|---|
| DE | 37 33 435 A 1 | 4/1989 |
| DE | 197 29 529 A 1 | 3/1998 |
| DE | 197 48 832 A 1 | 5/1999 |
| DE | 100 45 400 A 1 | 3/2002 |

* cited by examiner

*Primary Examiner*—Monica Carter
*Assistant Examiner*—Eric A. Gates
(74) *Attorney, Agent, or Firm*—Alix, Yale & Ristas, LLP

(57) ABSTRACT

A book pressing machine (1) comprises a pressing station for pressing the book cover (2*b*) on to the book block (2*a*), which pressing station includes a pressing table (4) and a pressing plate (5) movable perpendicularly to the pressing table (4) for all-over pressing of the book (2) with the book (2) lying flat, and comprises means (15*a,b*) for aligning the book (2) in the pressing station and an endless conveyor belt (6) which conveys the book (2) in and out, the upper belt section of which rests on the upper face of the pressing table (4) as a support for the book (2). With a view to simple and cost-effective construction a conveyor direction (F) of the conveyor belt (6) disposed transversely to the book spine (2*d*) is provided for conveying the book (2) in and out with the spine (2*d*) leading; a knife edge (4*a*) forming the front deflecting element for the conveyor belt (6) is provided in the pressing table (4), and a separate pressing rail (21), which forms the front end-piece of the pressing plate (5) and performs a reciprocating horizontal movement in addition to its vertical movement ($H_2$), is provided for holding down the book cover as the pressing plate (5) is opened and for accelerating the book (2) as the latter is conveyed out.

13 Claims, 3 Drawing Sheets

BOOK PRESSING MACHINE

BACKGROUND OF THE INVENTION

The present invention relates to a book pressing machine having a pressing station for pressing a book cover on to a book block.

After the book block has been inserted into the book cover a permanent contact between the front and back end papers of the book block and the book cover without cavities is obtained by pressing the book. In industrial book production this work process of all-over pressing is carried out in fold-forming and pressing machines in combination with the fold-forming process in which the folds of the book cover are formed and glued.

Known from DE 37 33 435 A1 is a fold-forming and pressing machine which comprises a loading station, a plurality of fold-forming and pressing stations and an unloading station, books freshly inserted in an upstream book insertion machine and fed therefrom by a continuous conveyor with their spines leading being distributed to the individual fold-forming and pressing stations where a single fold-forming and pressing process is carried out with the book lying flat. Each of the fold-forming and pressing stations has a horizontally arranged pressing table and a vertically movable pressing plate for all-over pressing, a pair of vertically movable fold-forming rails for fold formation, a shaping element acting against the front edge of the book block, a two-part shaping rail for the book spine and an endless conveyor belt which conveys the book in and out and the sections of which enclose the pressing table in such a way that the upper belt section rests on the upper face of the pressing table as a support for the book.

The book is transported through the fold-forming and pressing station in the longitudinal direction of the spine, so that for entry to these stations re-orienting of the book is required. To align the book with respect to the fold-forming rails arranged laterally beside the conveyor belt and in the longitudinal direction of the conveyor a transverse displacement is also required, which is carried out by means of the shaping element acting on the front edge of the book block between the pressing table and the pressing plate. These re-orientations and transverse displacements of the freshly-assembled book sometimes cause a change in the relative positions of book cover and book block, so that the quality of the book after fold-forming and pressing is endangered. In the case of some cover materials in conjunction with the all-over pressing of the upper cover board by the pressing plate, this cover board adheres to the pressing plate as the latter opens. This leads to malfunctions in conveying the book out.

Known from DE 197 48 832 A1 is a book forming and pressing machine in which, in a first pressing station, the cover boards of a book transported with the spine leading are pressed on to the book block, starting at a distance from the book cover folds, by rotatably driven press rollers rolling on the side surfaces of the book and, in a second station following at a distance in the transport direction of the book, the book is aligned by means of a two-part forming rail movable into the plane of motion of the book and a shaping element acting against the front edge of the book block, and is pressed in the cover folds and adjoining lateral areas by means of a pair of fold-forming rails and a pair of pressing rails. The book forming and pressing machine is characterised by its simple and cost-effective construction. The conveying of the book, which is fed from the book insertion machine while lying flat and without reorientation, is also advantageous. In the case of certain materials of the book cover and book block, however, high pressures are required to achieve cavity-free pasting of the front and back end papers to the cover, leading to curvature of the book covers during rolling and impairing the reliability of further processing.

DE 197 29 529 A1 describes a method whereby the cover fold is formed with the application of heat to the cover material before the insertion of the book block into the cover, so that the fold-forming in a separate machine used hitherto can be dispensed with. The permanent gluing of the cover fold to the book block is achieved by pressing the pre-formed cover fold against the book block when inserting the book. All-over pressing is carried out after joining book block and cover by rolling with press rollers which can optionally have a longitudinal groove for pressing directly on the book fold. What was said above regarding pressing-on at high pressures applies here also.

SUMMARY OF THE INVENTION

It is the object of the present invention to provide a book pressing machine which makes possible reliable, all-over pressing of the cover on to the book block while being of simple and cost-effective construction, and with which high quality in the book is attainable.

In general, the improvement according to the invention can be considered as comprising that: the conveyor belt operates in a transport direction (F) that cyclically conveys the book into and out of the pressing position with the spine leading; the front of the pressing table forms a sharp edge for deflecting the conveyor belt away from the transport direction; a pressing rail separate from the pressing plate forms a front end-piece for the pressing plate and is operatively associated with the pressing plate to provide vertical movement for holding down the book cover as the pressing plate is opened and reciprocating horizontal movement for accelerating the book as the book is conveyed out of the pressing position.

The conveyor belt is arranged in the book pressing machine in such a way that the book coming from the book insertion machine is conveyed through the pressing station without reorientation or lateral displacement and with the spine leading, the spine projecting from the front of the pressing station during all-over pressing. So that the lateral areas close to the fold of the cover resting on the conveyor belt can be pressed directly on to the book block, the front belt deflecting element is configured as a sharp edge. The upper pressing plate has a front end-piece which is movable forwards and backwards as a pressing rail in addition to its vertical movement. During all-over pressing the pressing rail is used together with the pressing plate for pressing the full area of the upper cover on to the book block. When the pressing plate is opened the pressing rail holds down the upper cover board, which may adhere to the pressing plate, and then accelerates the book for conveying out by moving forwards simultaneously with the conveyor belt.

The pressing rail is advantageously movable back and forth in a pivotal manner. It is advantageous if the pressing rail is configured as a segment of a roller having a radius corresponding to the pivot radius when accelerating. A preferred refinement of the invention provides that the alignment means are formed by two spine stops which are movable into and out of the plane of motion of the book from above and below and are adjustable to the shape of the spine, and that the book is conveyed against them by the conveyor belt through an additional movement. The edges of the cover board associated with the fold area of the book are aligned exactly with the front edges of the pressing table and of the pressing rail. A shaping element for pushing the book into this position is not required. It has proved advantageous if the conveyor belt has a rearward transporting section offering at least one intermediate position to the cyclically-fed book and has a pressing wheel which retains the book on the conveyor belt, making it possible to remove a freshly inserted book from the conveyor line upstream of the book pressing machine for inspection.

The book pressing machine according to the invention can be simply converted into a book pressing and forming machine by the arrangement of a pair of fold-pressing rails, which are movable perpendicularly to the pressing table, in front of the pressing table and the pressing rail. An imprinting function can be integrated in the book pressing machine by the use of an imprinting plate instead of or below the above-mentioned pressing plate.

BRIEF DESCRIPTION OF THE DRAWING

The preferred embodiment of invention is described below with reference the drawings, in which.

DESCRIPTION OF THE PREFERRED EMBODIMENT

Figure 1:
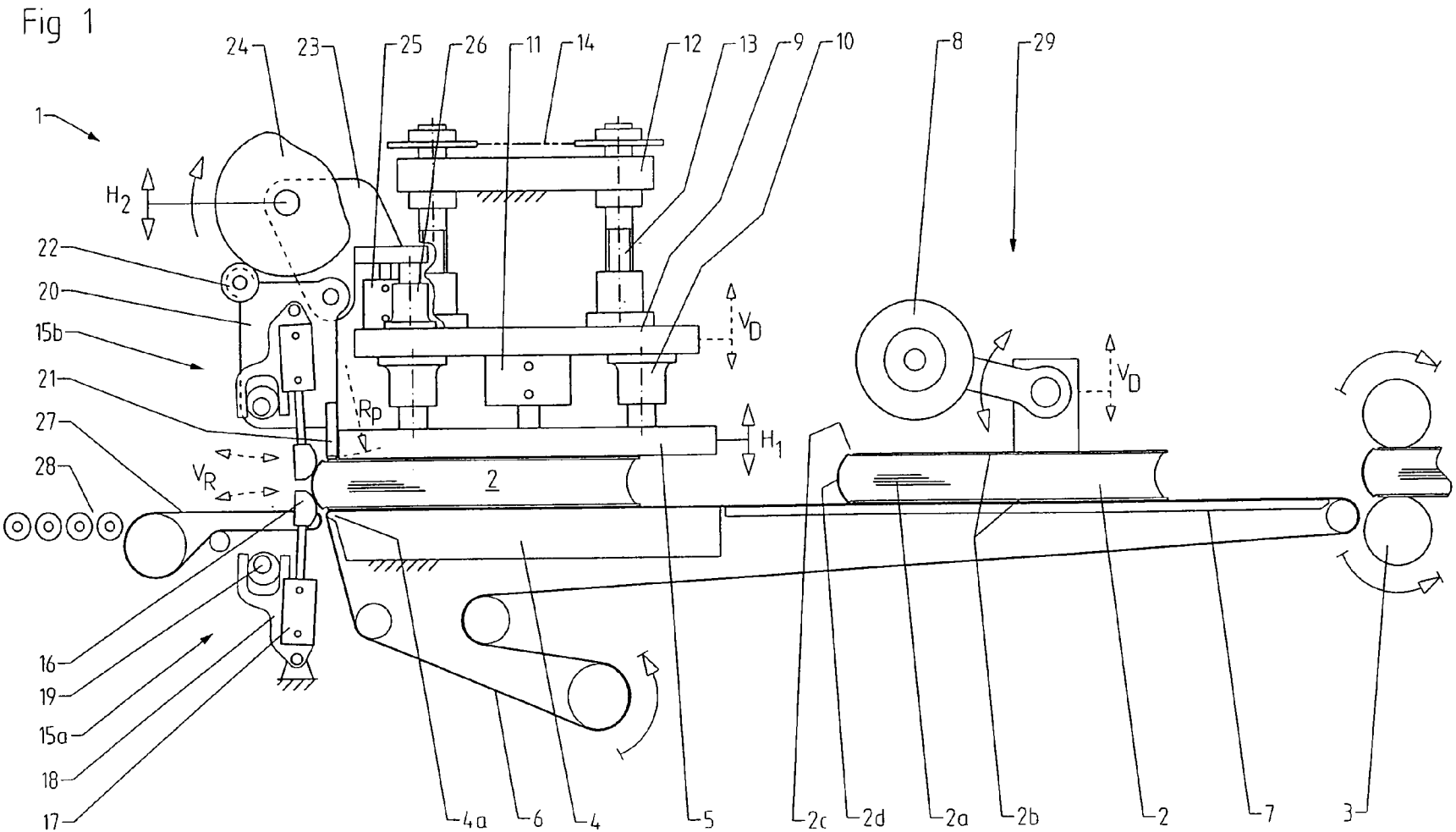
FIG. 1 shows a front view of a book pressing machine according to the invention while pressing the book cover on to the book block.

The book pressing machine 1 according to the invention takes over the books 2 discharged cyclically from a book insertion machine by means of intermittently driven discharge rollers 3 with a conveyor belt 6, which conveys the books 2, which lie flat with the spines 2*d* leading, through the book pressing machine 1 in two cycles. In the first cycle the books 2 are conveyed to an intermediate position 29 which allows the machine operator to remove the freshly inserted book 2 from the conveyor line formed by the book insertion machine and the book pressing machine 1. For reliable further transportation to the pressing position the book 2 is urged against the conveyor belt 6 by means of a pressing wheel 8 which is adjustable $V_D$ to book thickness.

The endless conveyor belt 6 circulating cyclically in the transport direction F rests in its rearward portion on a support plate 7 whereas in its front portion it is supported on a horizontally arranged pressing table 4 which has a knife (sharp) edge 4*a* for deflecting the belt away from the transport direction at the front of the pressing table. In the second cycle the book 2 is conveyed an additional distance against a two-part spine stop 15*a,b*, which is movable into the plane of movement of the book 2 in front of the pressing table 4, and is aligned thereby on the pressing table 4 in such a way that the fold 2*c* is disposed parallel to the knife edge 4*a* and the lower board of the book cover 2*b* rests almost entirely on the pressing table 4.

The pressing process begins with the lowering ($H_1$) of an upper pressing plate 5 which does not extend quite as far as the fold 2*c*, is guided perpendicularly to the pressing table 4 in guides 10 and generates a defined compressive force by means of a cylinder 11 which can be charged with compressed air. The withdrawal of the spine stops 15*a,b* is followed by the lowering ($H_2$) of a narrow pressing rail 21 which presses the upper lateral area of the book 2 close to the fold and not covered by the pressing plate 5. As the book 2 is pressed a permanent contact of the front and back end papers of the book block 2*a* with the book cover 2*b* is obtained.

Figure 2:
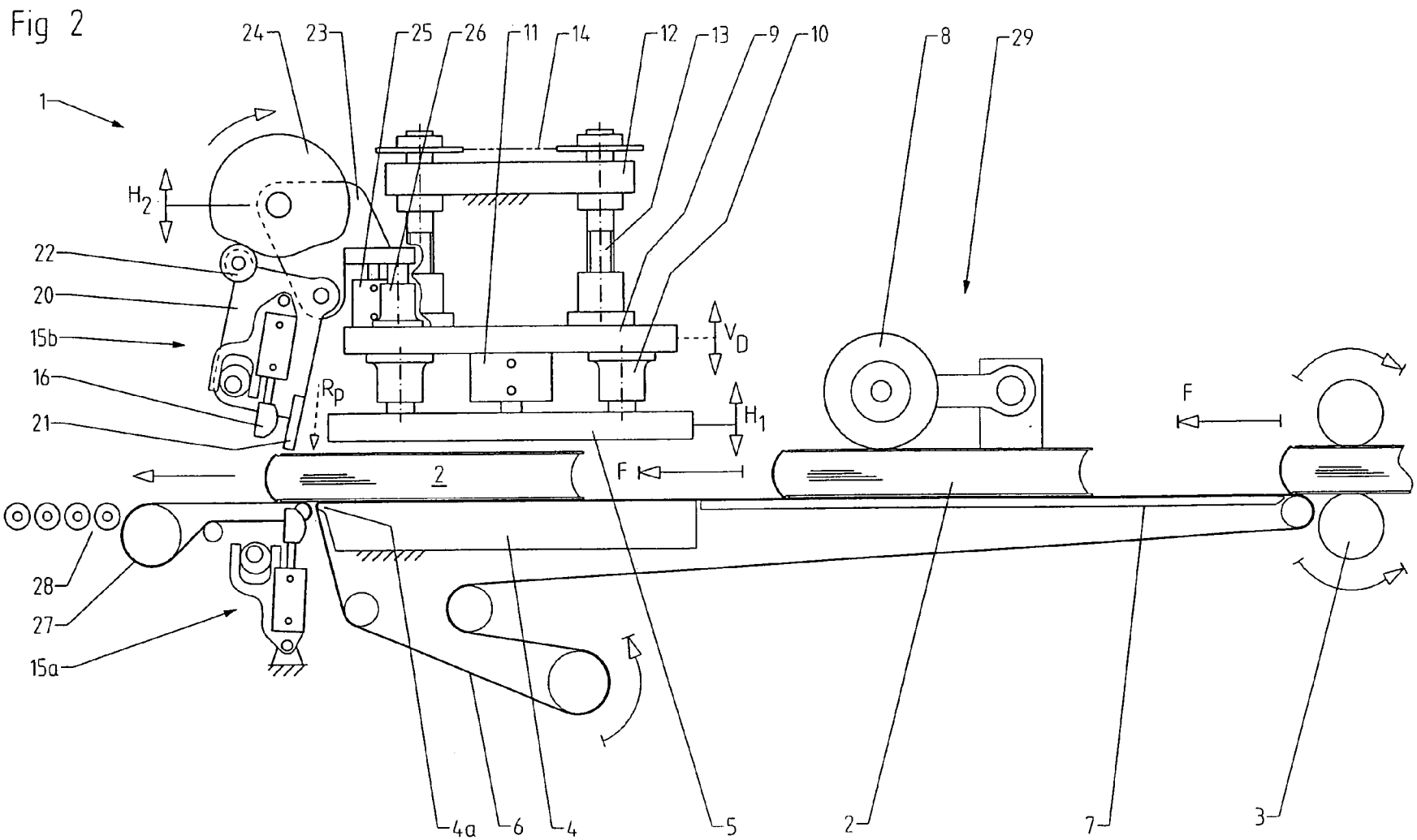
FIG. 2 shows the book pressing machine from FIG. 1 while conveying the book out.

The otherwise usual fold-forming whereby the folds 2*c* are formed and glued is not provided in the embodiment according to FIG. 1 and FIG. 2. Using known methods and devices it is possible to apply the folds 2*c* to the book cover 2*b* before the joining of the book block 2*a* to the cover 2*b*. During insertion it is then sufficient for the pre-formed cover folds to be pressed against the book block 2*a* in order to obtain a permanent bond in the area of the fold 2*c*.

At the end of the pressing process the pressing plate 5 opens while the front pressing rail 21 for holding down the upper cover board, which may adhere to the pressing plate 5, still acts on the book 2; at the same time as the book 2 is conveyed out by the conveyor belt 6 the front pressing rail 21 pivots forward to accelerate the discharge of the book 2 in a slip-free manner. This operation is illustrated in FIG. 2. Via a continuously circulating discharge belt 27 the pressed books 2 reach an onward conveyor, which in the embodiment illustrated is in the form of an accumulating roller conveyor 28.

The spine stops 15*a,b* are formed by comb-like intermeshing stop fingers 16 which are movable into and out of the plane of motion of the books 2 by cylinders 17. The cylinders 17 are fixed to rotatably journalled mounts 18. For adaptation to different spine shapes an adjustment $V_R$ is provided, whereby the mounts 18 can be moved to different positions by the rotation of eccentric shafts 19.

The pivot point of the upper spine stop 15*b* and the bearing arrangement of the associated eccentric shaft 19 are located in a plate 20, which in turn is swivellable about a pivot point in a support plate 23. The pressing rail 21, the pressing face of which has a radius $R_P$ corresponding to the swivel radius, is fixed to the plate 20. To execute the cyclical reciprocating motion of the pressing rail 21 a cam control, which comprises a cam disc 24 journalled in the support plate 23 and circulating in cyclical synchronicity and a cam roller 22 bearing against the control cam, is provided for the swivelling motion of the plate 20.

The vertical movement $H_2$ of the pressing rail 21 is generated by activation of a cylinder 25 which moves the support plate 23, which is guided perpendicularly to the pressing table 4 by means of guides 26, up and down according to the sequence of the above-described pressing operation. The movements of the pressing plate 5 and the pressing rail 21 take place relatively to an intermediate plate 9, which is adjustable ($V_D$) with respect to book thickness perpendicularly to the pressing table 4 by means of adjusting spindles 13 supported by a plate 12 fixed to the frame and drivingly connected via a chain drive 14.

Figure 3:
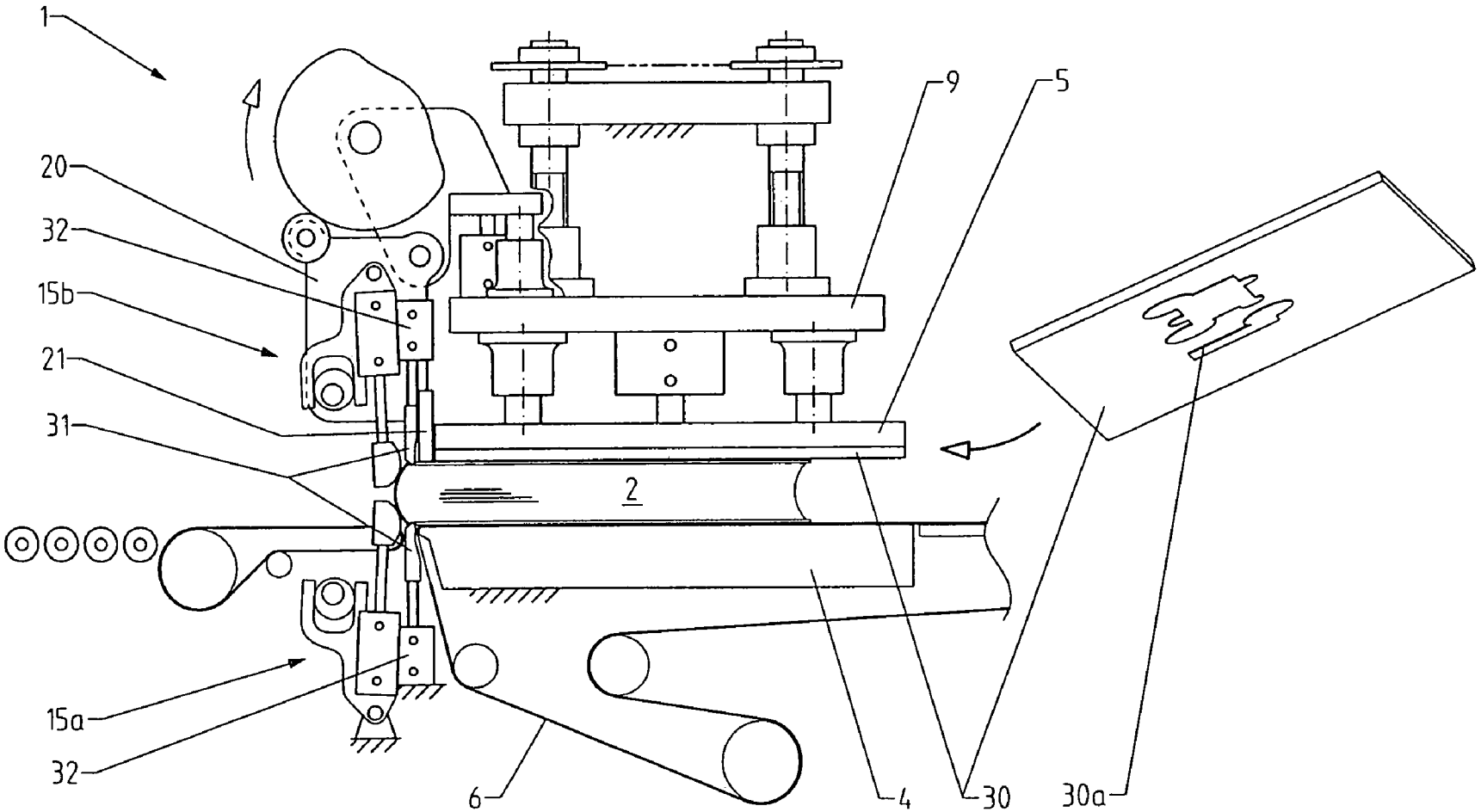
FIG. 3 shows a variant of the book pressing machine with integrated fold-pressing rails and an imprinting plate.

FIG. 3 shows a variant in which the book pressing machine 1 according to the invention is configured as a book pressing and forming machine with integrated imprinting function. By means of an imprinting plate 30, configured as an exchangeable part, which can be inserted instead of or below the pressing plate 5 and is provided with embossed elements 30*a*, it is possible to apply depressed imprints to the cover on the upper side of the book. By arranging a pair of fold-pressing rails 31 movable perpendicularly to the pressing table 4 and controlled by cylinders 32 in front of the pressing table 4 and the pressing rail 21, the folds 2*c* can be further impressed or, if heated fold-pressing rails 31 are used, can be hot-formed.

The invention claimed is:

1. A book pressing machine, including a pressing station for pressing a book cover onto a book block, which pressing station includes a substantially horizontally arranged pressing table and a pressing plate movable perpendicularly to the pressing table for all-over pressing of the book with the book lying flat; means for aligning the book in the pressing station; and an endless conveyor belt which conveys the book in a transport direction on a transport plane into and out of a pressing position under the pressing plate, said belt having an upper portion which rests on the pressing table as a support for the book and is thereafter deflected away from the transport direction; wherein the improvement comprises that: the conveyor belt operates in a transport direction that cyclically conveys the book into and out of the pressing position with the spine leading; the front of the pressing table forms a sharp edge for deflecting the conveyor belt away from the transport direction; a pressing rail separate from the pressing plate forms a front end-piece for the pressing plate and is operatively associated with the pressing plate to provide vertical movement for holding down the book cover as the pressing plate is opened and reciprocating horizontal movement for accelerating the book as the book is conveyed out of the pressing position.

2. Book pressing machine according to claim 1, wherein the pressing rail is pivotally mounted in front of the pressing plate to provide said reciprocating horizontal movement.

3. Book pressing machine according to claim 2, wherein the pivoted pressing rail is configured as a segment of a roller having a radius corresponding to the pivot radius when accelerating.

4. Book pressing machine according to claim 1, wherein the means for aligning are formed by two spine stops which are movable into and out of said transport plane from below and above and are adjustable to the shape of the spine, and the book is conveyed against said spine stops by distinct increment of movement of the conveyor belt.

5. Book pressing machine according to claim 1, wherein the conveyor belt has a rearward conveyor portion offering the cyclically-fed book at least one intermediate position and a pressing wheel is situated at each said intermediate position for urging the book against the conveyor belt.

6. Book pressing machine according to claim 1, wherein a pair of fold-pressing rails are arranged in front of the pressing table and the pressing rail and movable perpendicularly to the pressing table.

7. Book pressing machine according to claim 1, wherein the pressing plate is exchangeable with an imprinting plate having embossed elements for embossing one side of the book.

8. Book pressing machine according to claim 1, wherein the pressing plate carries an imprinting plate that faces the pressing table and has embossed elements for embossing one side of the book.

9. Book pressing machine according to claim 2, wherein the means for aligning are formed by two spine stops which are movable into and out of said transport plane from below and above and are adjustable to the shape of the spine, and the book is conveyed against said spine stops by an additional movement of the conveyor belt.

10. Book pressing machine according to claim 2, wherein the conveyor belt has a rearward conveyor portion offering the cyclically-fed book at least one intermediate position and a pressing wheel is situated at each said intermediate position for urging the book against the conveyor belt.

11. Book pressing machine according to claim 2, wherein a pair of fold-pressing rails are arranged in front of the pressing table and the pressing rail and movable perpendicularly to the pressing table.

12. Book pressing machine according to claim 3, wherein the means for aligning are formed by two spine stops which are movable into and out of said transport plane from below and above and are adjustable to the shape of the spine, and the book is conveyed against said spine stops by distinct increment of movement of the conveyor belt.

13. Book pressing machine according to claim 4, wherein a pair of fold-pressing rails are arranged in front of the pressing table and the pressing rail and movable perpendicularly to the pressing table.

* * * * *